US010283844B2

(12) United States Patent
Rajagopalan et al.

(10) Patent No.: US 10,283,844 B2
(45) Date of Patent: May 7, 2019

(54) ELECTRONIC DEVICES HAVING HOUSING-INTEGRATED DISTRIBUTED LOOP ANTENNAS

(71) Applicant: Apple Inc., Cupertino, CA (US)

(72) Inventors: Harish Rajagopalan, San Jose, CA (US); Pietro Romano, Mountain View, CA (US); Rodney A. Gomez Angulo, Sunnyvale, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 181 days.

(21) Appl. No.: 15/275,192

(22) Filed: Sep. 23, 2016

(65) Prior Publication Data

US 2018/0090817 A1 Mar. 29, 2018

(51) Int. Cl.

| | |
|---|---|
| ***H01Q 7/00*** | (2006.01) |
| ***H01Q 1/22*** | (2006.01) |
| ***H01Q 1/24*** | (2006.01) |
| ***H01Q 1/48*** | (2006.01) |
| ***H01Q 9/42*** | (2006.01) |

(Continued)

(52) U.S. Cl.

CPC ..... *H01Q 1/243* (2013.01); *H01Q 1/2291* (2013.01); *H01Q 1/48* (2013.01); *H01Q 5/378* (2015.01); *H01Q 5/385* (2015.01); *H01Q 7/005* (2013.01); *H01Q 9/42* (2013.01)

(58) Field of Classification Search

CPC .. H01Q 1/2258; H01Q 1/2266; H01Q 1/2275; H01Q 1/2291; H01Q 1/24; H01Q 1/241; H01Q 1/242; H01Q 1/243; H01Q 5/30; H01Q 5/307; H01Q 5/314;

(Continued)

(56) References Cited

U.S. PATENT DOCUMENTS 8,854,266 B2 * 10/2014 Zhu ..... H01Q 1/2266 343/702

2012/0235881 A1 9/2012 Pan et al.

(Continued)

OTHER PUBLICATIONS

Hsu et al., "Compact Multiband Antenna for Handsets with a Conducting Edge" IEEE Transactions of Antennas and Propagation, vol. 63, No. 11, Nov. 2015, 6 pages.

*Primary Examiner* — Daniel Munoz
*Assistant Examiner* — Patrick R Holecek
(74) *Attorney, Agent, or Firm* — Treyz Law Group, P.C.; Michael H. Lyons; Tianyi He

(57) ABSTRACT

An electronic device may include a metal housing and a distributed loop antenna. The antenna may include a dielectric carrier. The antenna may include a distributed loop antenna resonating element that extends around the carrier and a loop antenna feed element on the carrier. Portions of the feed element and loop antenna resonating element may be formed from the housing. The feed element may be directly fed and may indirectly feed the distributed loop antenna resonating element via near field electromagnetic coupling. The loop antenna resonating element may include a conductive sheet on the carrier. The conductive sheet and the housing may form a conductive loop path of the loop antenna resonating element. A capacitance may be interposed in the conductive loop path and may be formed by a gap between the conductive sheet and the housing. A speaker driver may be placed within a cavity in the carrier.

13 Claims, 13 Drawing Sheets

(51) Int. Cl.
*H01Q 5/378* (2015.01)
*H01Q 5/385* (2015.01)

(58) Field of Classification Search
CPC ..... H01Q 5/321; H01Q 5/378; H01Q 5/385; H01Q 9/42; H01Q 7/00; H01Q 7/005
See application file for complete search history.

(56) References Cited

U.S. PATENT DOCUMENTS

| | | | | |
|---|---|---|---|---|
| 2013/0147664 | A1 | 6/2013 | Lin | |
| 2014/0086441 | A1* | 3/2014 | Zhu | H01Q 1/243 381/332 |
| 2015/0295314 | A1 | 10/2015 | Oh | |
| 2016/0013543 | A1 | 1/2016 | Nguyen | |

* cited by examiner

ELECTRONIC DEVICES HAVING HOUSING-INTEGRATED DISTRIBUTED LOOP ANTENNAS

BACKGROUND

This relates to electronic devices, and more particularly, to antennas for electronic devices with wireless communications circuitry.

Electronic devices such as portable computers and cellular telephones are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies and with a satisfactory efficiency bandwidth.

It would therefore be desirable to be able to provide improved wireless communications circuitry for wireless electronic devices.

SUMMARY

An electronic device may have a metal housing that forms a ground plane. The metal housing may, for example, include a rear housing wall and sidewalls of the electronic device. The metal housing and other structures in the electronic device may be used in forming antennas.

The electronic device may include one or more distributed loop antennas. The antenna may include a dielectric carrier. The dielectric carrier may have an elongated shape that extends along a longitudinal axis. The antenna may include a distributed loop antenna resonating element formed over the carrier that extends around the longitudinal axis. The antenna may include a loop antenna feed element formed on the dielectric carrier. A portion of the loop antenna feed element and a portion of the distributed loop antenna resonating element may be formed from the metal housing. For example, a sidewall of the metal housing may form a part of the loop antenna feed element and a part of the distributed loop antenna resonating element. A rear wall of the metal housing may also form a part of the distributed loop antenna resonating element.

A first antenna feed terminal and a second antenna feed terminal may be directly connected to the loop antenna feed element. The feed element may receive radio-frequency signals from transceiver circuitry using a radio-frequency transmission line. The feed element may indirectly feed the radio-frequency signals to the distributed loop antenna resonating element via near field electromagnetic coupling. The feed element may exhibit an antenna resonance at a first frequency (e.g., 5.0 GHz) whereas the distributed loop antenna resonating element exhibits an antenna resonance at a second frequency (e.g., 2.4 GHz). A capacitor may be coupled between the feed element and the distributed loop antenna resonating element to reduce the second frequency if desired. If desired, a parallel tank circuit may be formed on the feed element to enhance isolation between signals at the first and second frequencies.

The distributed loop antenna resonating element may be formed from a conductive sheet placed over first and second sides of the dielectric carrier. The conductive sheet may be shorted to the rear wall of the metal housing using a conductive fastener. The conductive sheet, the rear wall of the metal housing, and the sidewall of the metal housing may form a conductive loop path of the distributed loop antenna resonating element. A capacitance may be interposed in the conductive loop path. The capacitance may be formed by a gap having edges defined by the conductive sheet and the conductive sidewall. A speaker driver may be placed within an air-filled cavity in the dielectric substrate.

The electronic device may include a display having an active area that emits light and an inactive area. The antenna may be placed within the inactive area. By forming part of the feed element and part of the distributed loop antenna resonating element using the metal housing, the size of the inactive area may be reduced while still allowing the antenna to exhibit sufficient bandwidth efficiency at frequencies of interest.

DETAILED DESCRIPTION

Figure 1:
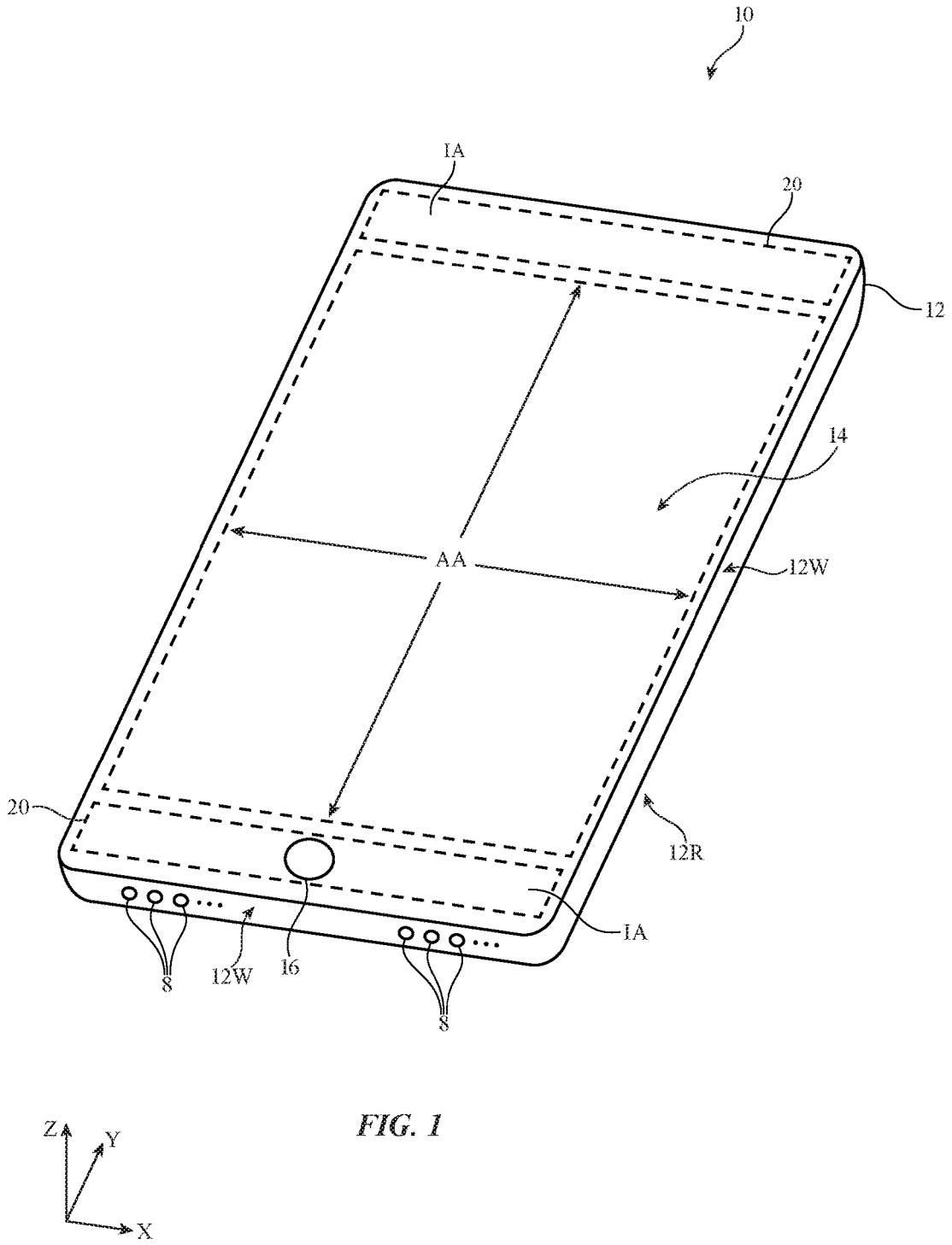
FIG. 1 is a perspective view of an illustrative electronic device in accordance with an embodiment.

An electronic device such as electronic device 10 of FIG. 1 may be provided with wireless circuitry that includes antennas. The antennas may be used to transmit and receive wireless signals.

The wireless circuitry of device 10 may handle one or more communications bands. For example, the wireless circuitry of device 10 may include a Global Position System (GPS) receiver that handles GPS satellite navigation system signals at 1575 MHz or a GLONASS receiver that handles GLONASS signals at 1609 MHz. Device 10 may also contain wireless communications circuitry that operates in communications bands such as cellular telephone bands and wireless circuitry that operates in communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications at 13.56 MHz or other near-field communications frequencies. If desired, device 10 may include wireless communications circuitry for communicating at 60 GHz, circuitry for supporting light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

In the example of FIG. 1, device 10 includes a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). In the example of FIG. 1, housing 12 includes a conductive peripheral sidewall structure 12W that surrounds a periphery of device 10 (e.g., that surrounds the rectangular periphery of device 10 as shown in FIG. 1). Housing 12 may, if desired, include a conductive rear wall structure 12R that opposes display 14 (e.g., conductive rear wall structure 12R may form the rear exterior face of device 10). If desired, rear wall 12R and sidewalls 12W may be formed from a continuous metal structure (e.g., in a unibody configuration) or from separate metal structures. Openings may be formed in housing 12 to form communications ports, holes for buttons, and other structures if desired.

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may have an active area AA that includes an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10 (e.g., extending across an entirety of a length dimension of device 10 parallel to the y-axis and a width dimension of device 10 parallel to the x-axis of FIG. 1). In another suitable arrangement, the display cover layer may cover substantially all of the front face of device 10 or only a portion of the front face of device 10. Openings may be formed in the display cover layer. For example, an opening may be formed in the display cover layer to accommodate a button such as button 16. An opening may also be formed in the display cover layer to accommodate ports such as a speaker port. Openings such as openings 8 may be formed in housing 12 to form communications ports (e.g., an audio jack port, a digital data port, etc.) and/or audio ports for audio components such as a speaker and/or a microphone.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layer in display 14 that overlaps inactive area IA may be coated with an opaque masking layer in inactive area IA. The opaque masking layer may have any suitable color.

Antennas may be mounted in housing 12. For example, housing 12 may have four peripheral edges (e.g., conductive sidewalls 12W) as shown in FIG. 1 and one or more antennas may be located along one or more of these edges. As shown in the illustrative configuration of FIG. 1, antennas may, if desired, be mounted in regions 20 along opposing peripheral edges of housing 12 (as an example). The antennas may include antenna resonating elements that emit and receive signals through the front of device 10 (i.e., through inactive portions IA of display 14) and/or from the rear and sides of device 10. In practice, active components within active display area AA may block or otherwise inhibit signal reception and transmission by the antennas. By placing the antennas within regions 20 of inactive area IA of display 14, the antennas may freely pass signals through the display without the signals being blocked by active display circuitry. Antennas may also be mounted in other portions of device 10, if desired. The configuration of FIG. 1 is merely illustrative.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the space 20 that is available for forming antennas within device 10. In general, antennas that are provided with larger operating volumes or spaces may have higher bandwidth efficiency than antennas that are provided with smaller operating volumes or spaces. If care is not taken, increasing the size of active area AA may reduce the operating space available to the antennas, which can undesirably inhibit the efficiency bandwidth of the antennas (e.g., such that the antennas no longer exhibit satisfactory radio-frequency performance). It would therefore be desirable to be able to provide antennas that occupy a small amount of space within device 10 (e.g., to allow for as large of a display active area AA as possible) while still allowing the antennas to operate with optimal efficiency bandwidth.

Figure 2:
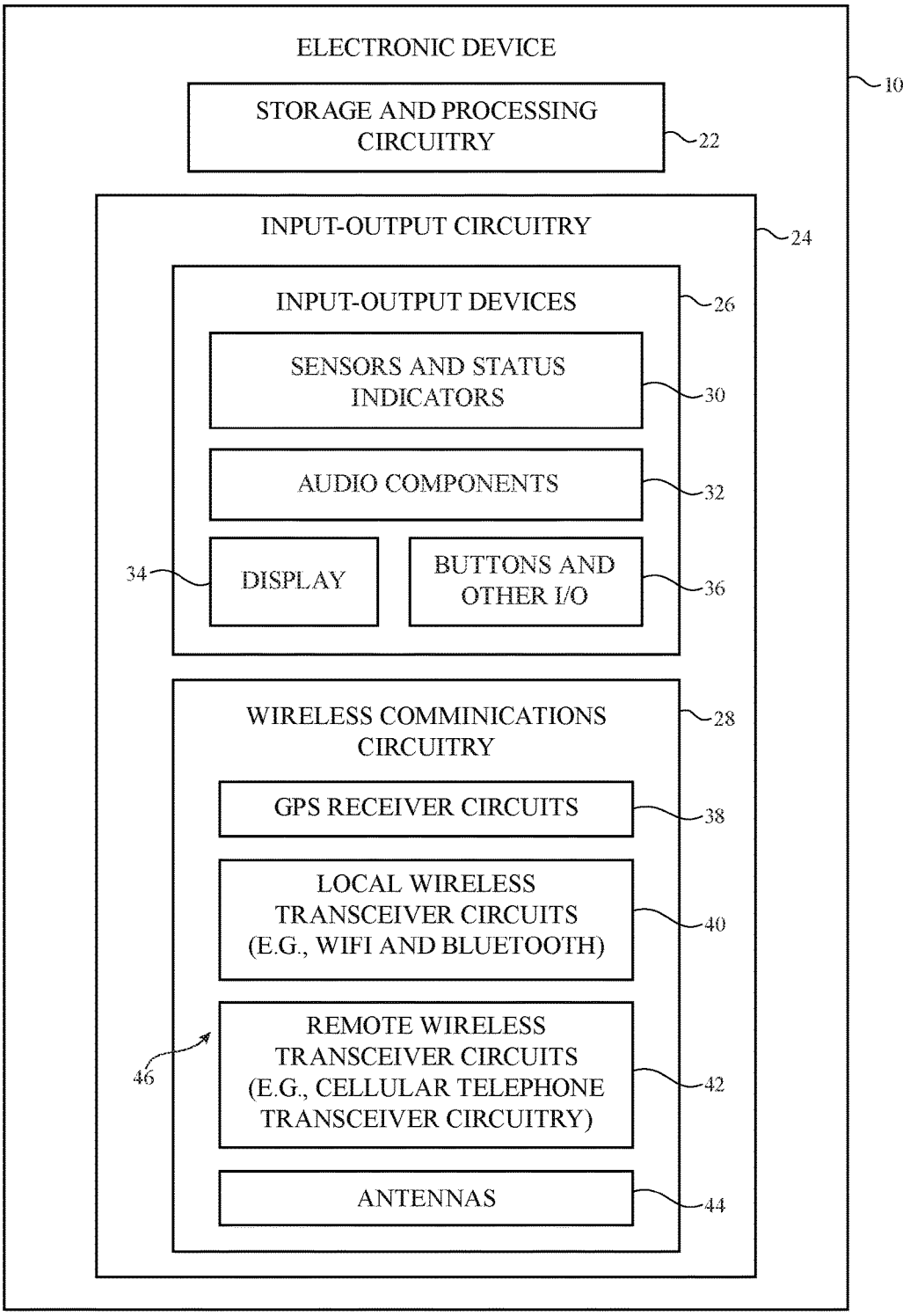
FIG. 2 is a schematic diagram of illustrative circuitry in an electronic device in accordance with an embodiment.

A schematic diagram showing illustrative components that may be used in device 10 is shown in FIG. 2. As shown in FIG. 2, device 10 may include control circuitry such as storage and processing circuitry 22. Storage and processing circuitry 22 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 22 may be used to control the operation of device 10. This processing circuitry may be based on one or more microprocessors, microcontrollers, digital signal processors, application specific integrated circuits, etc.

Storage and processing circuitry 22 may be used to run software on device 10, such as internet browsing applications, voice-over-internet-protocol (VOIP) telephone call applications, email applications, media playback applications, operating system functions, etc. To support interactions with external equipment, storage and processing circuitry 22 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 24 may include input-output devices 26. A user can control the operation of device 10 by supplying commands (user input) through input-output devices 26 and may receive status information and other output from device 10 using the output resources of input-output devices 26.

Input-output devices 26 may include sensors and status indicators 30 such as an ambient light sensor, a proximity sensor, a temperature sensor, a pressure sensor, a magnetic sensor, an accelerometer, gyroscope, compass, and light-emitting diodes and other components for gathering information about the environment in which device 10 is operating and providing information to a user of device 10 about the status of device 10.

Input-output devices 26 may include audio components 38. Audio components 38 may include speakers and tone generators for presenting sound to a user of device 10 and microphones for gathering user audio input. As an example, speakers in audio components 38 may include acoustic cavities and speaker drivers that are placed within the acoustic cavities. When the speaker drives are driven with electrical audio (speaker) signals, the speaker driver may produce mechanical sound waves that resonate within the acoustic cavity. The acoustic cavity may amplify the sound waves to audible levels. The amplified sound waves may pass through audio ports such as speaker holes 8 of FIG. 1 so that they can be heard by a user of device 10.

Display 14 may be used to present images for a user such as text, video, and still images. Sensors 30 may include a touch sensor array that is formed as one of the layers in display 14, for example. User input may be gathered using buttons and other input-output components 36 such as touch pad sensors, buttons, joysticks, scrolling wheels, click wheels, touch pads, key pads, keyboards, microphones, cameras, digital data port devices, etc.

Input-output circuitry 24 may include wireless communications circuitry 28 for communicating wirelessly with external equipment. Wireless communications circuitry 28 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 28 may include radio-frequency transceiver circuitry 46 for handling various radio-frequency communications bands. For example, circuitry 28 may include transceiver circuitry 38, 40, and 42. Transceiver circuitry 40 may be wireless local area network transceiver circuitry that may handle 2.4 GHz and 5.0 GHz bands for wireless local area network communications such as WiFi® (IEEE 802.11) communications and that may handle the 2.4 GHz Bluetooth® communications band. Circuitry 28 may use cellular telephone transceiver circuitry 42 for handling wireless communications in frequency ranges such as a low communications band from 700 to 960 MHz, a midband from 1400 MHz or 1500 MHz to 2170 MHz (e.g., a midband with a peak at 1700 MHz), and a high band from 2170 or 2300 to 2700 MHz (e.g., a high band with a peak at 2400 MHz) or other communications bands between 700 MHz and 2700 MHz or other suitable frequencies (as examples). Circuitry 42 may handle voice data and non-voice data. Wireless communications circuitry 28 can include circuitry for other short-range and long-range wireless links if desired. For example, wireless communications circuitry 28 may include 60 GHz transceiver circuitry, circuitry for receiving television and radio signals, paging system transceivers, near field communications (NFC) circuitry, etc. Wireless communications circuitry 28 may include satellite navigation system circuitry such as global positioning system (GPS) receiver circuitry 38 for receiving GPS signals at 1575 MHz, Global Navigation Satellite System (GLONASS) signals, or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 28 may include antennas 44. Antennas 44 may be formed using any suitable antenna types. For example, antennas 44 may include antennas with resonating elements that are formed from loop antenna structures, patch antenna structures, inverted-F antenna structures, slot antenna structures, planar inverted-F antenna structures, monopole antenna structures, dipole antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
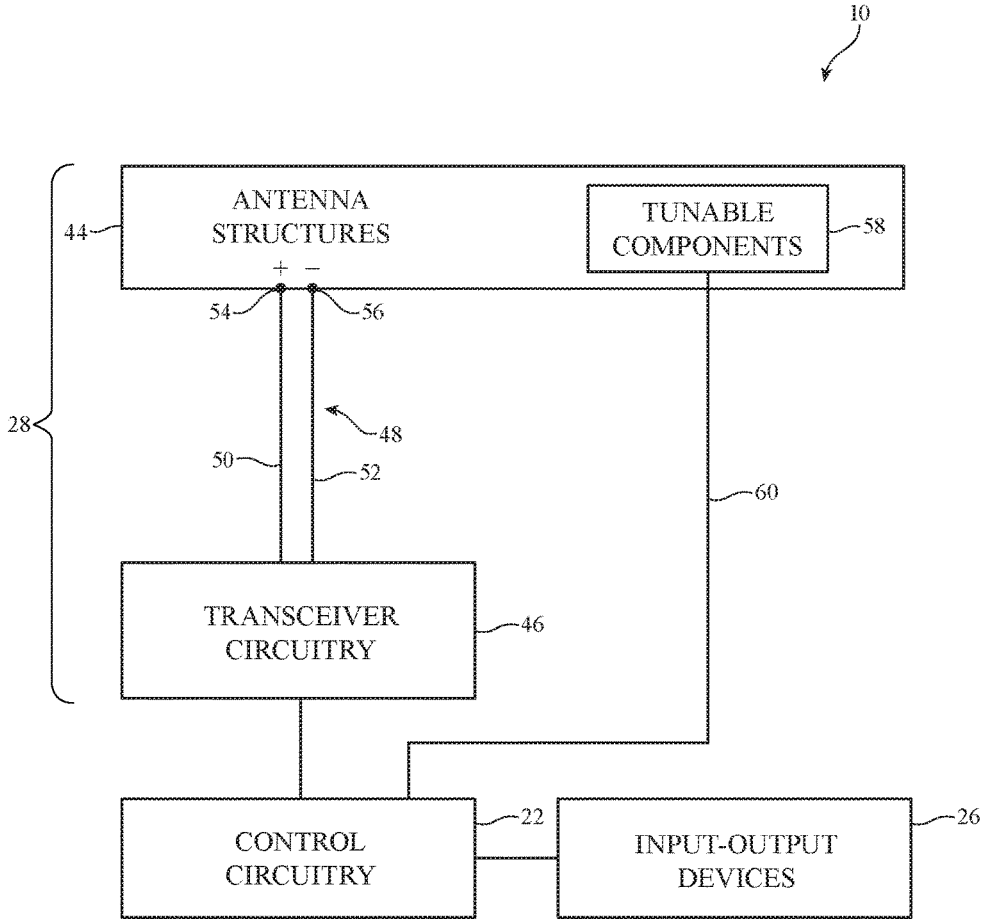
FIG. 3 is a diagram of illustrative wireless circuitry in an electronic device in accordance with an embodiment.

As shown in FIG. 3, transceiver circuitry 46 in wireless circuitry 28 may be coupled to antenna structures 40 using paths such as path 48. Wireless circuitry 28 may be coupled to control circuitry 22. Control circuitry 22 may be coupled to input-output devices 26. Input-output devices 26 may supply output from device 10 and may receive input from sources that are external to device 10.

To provide antenna structures 44 with the ability to cover communications frequencies of interest, antenna structures 44 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 44 may be provided with adjustable circuits such as tunable components 58 to tune antennas over communications bands of interest. Tunable components 58 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures.

During operation of device 10, control circuitry 22 may issue control signals on one or more paths such as path 60 that adjust inductance values, capacitance values, or other parameters associated with tunable components 58, thereby tuning antenna structures 44 to cover desired communications bands.

Path 48 may include one or more transmission lines. As an example, signal path 48 of FIG. 3 may be a transmission line having first and second conductive paths such as paths 50 and 52, respectively. Path 50 may be a positive signal line and path 52 may be a ground signal line. Lines 50 and 52 may form parts of a coaxial cable, a microstrip transmission line, or a stripline transmission line (as examples). A matching network (not shown) formed from components such as inductors, resistors, and capacitors may be used in matching the impedance of antenna structures 44 to the impedance of transmission line 48, if desired. Matching network components may be provided as discrete components (e.g., surface mount technology components) or may be formed from housing structures, printed circuit board structures, traces on plastic supports, etc. Components such as these may also be used in forming filter circuitry in antenna structures 44.

Transmission line 48 may be directly coupled to an antenna resonating element and ground for antenna 44 or may be coupled to near-field-coupled antenna feed structures for antenna 44. As an example, antenna structures 44 may form an inverted-F antenna, a slot antenna, a loop antenna, or other antenna having an antenna feed with a positive (signal) antenna feed terminal such as terminal 54 and a ground antenna feed terminal such as ground antenna feed terminal 56. Positive transmission line conductor 50 may be coupled to positive antenna feed terminal 54 and ground transmission line conductor 52 may be coupled to ground antenna feed terminal 56. Antenna structures 44 may include an antenna resonating element such as a loop antenna resonating element or other element that is indirectly fed using near-field coupling. In a near-field coupling arrangement, transmission line 48 is coupled to a near-field-coupled antenna feed structure that is used to indirectly feed antenna structures such as a loop antenna resonating element or other element through near-field electromagnetic coupling.

Antenna structures 44 may be formed from metal traces or other conductive material supported by a dielectric carrier. With one suitable arrangement, antenna structures 44 may be based on loop antenna structures. For example, antenna structures 44 may include a strip of conductive material that is wrapped or arranged into a loop. Because the strip of conductive material has an associated width across which material is distributed, loop antenna structures such as these may sometimes be referred to as distributed loop antenna structures. A distributed loop antenna may be fed using a direct feeding arrangement in which feed terminals such as terminals 54 and 56 are coupled directly to the strip of material that forms the loop, may be fed indirectly by using near-field electromagnetic coupling to couple a loop antenna feeding element or other element to the loop that is formed from the strip of material, or may be fed using other suitable feed arrangements.

Figure 4:
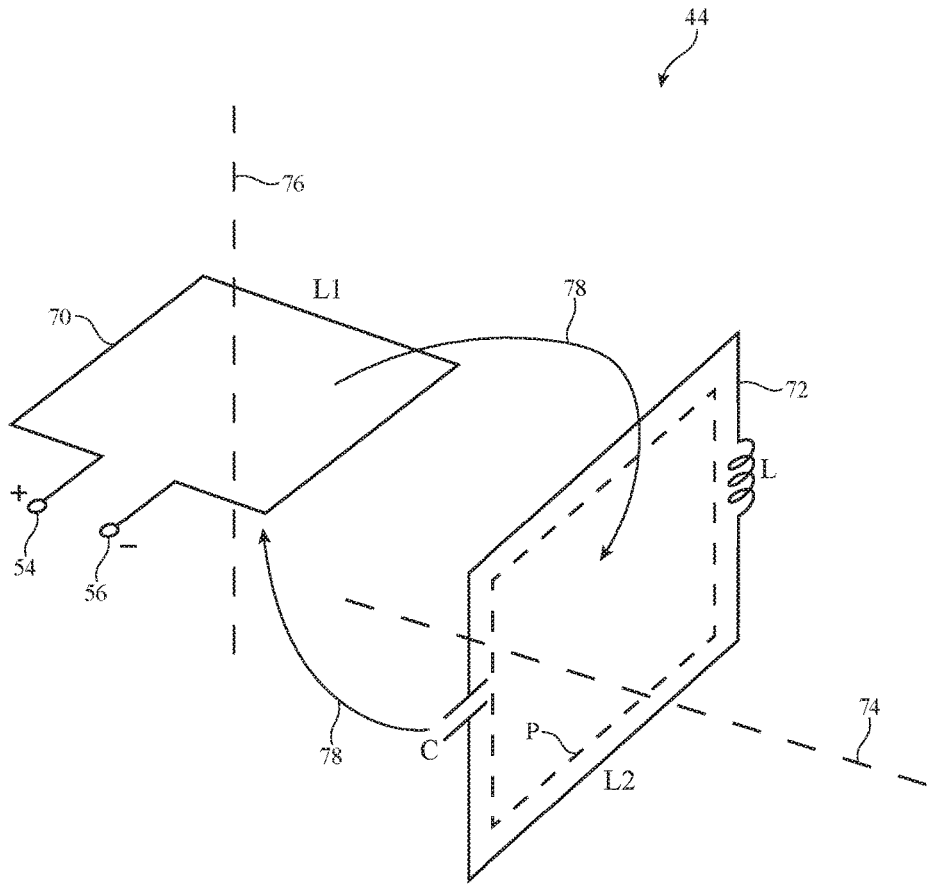
FIG. 4 is a diagram of illustrative distributed loop antenna structures in accordance with an embodiment.

A schematic diagram of a distributed loop antenna of the type that may be used in electronic device 10 is shown in FIG. 4. As shown in FIG. 4, distributed loop antenna structures 44 (sometimes referred to as distributed loop antenna 44 or indirectly fed distributed loop antenna 44) may include a first loop antenna resonating element L1 that is formed from a loop of conductor such as conductor 70 and a second loop antenna resonating element L2 (a distributed loop element) that is formed from a loop of conductor such as conductor 72.

As shown in FIG. 4, loop antenna resonating element L2 may be indirectly fed using loop-shaped antenna resonating element L1, which serves as an indirect antenna feeding structure. Loop-shaped antenna resonating element L1 may therefore sometimes be referred to herein as loop antenna feeding element L1, loop antenna feed L1, antenna feeding element L1, or antenna feed element L1. As illustrated by electromagnetic fields 78 of FIG. 4, antenna element L1 and loop-shaped antenna resonating element L2 may be coupled using near-field electromagnetic coupling.

Antenna structures 44 of FIG. 4 may be coupled to radio-frequency transceiver circuitry 46 (FIG. 3) using transmission line 48. For example, positive transmission line conductor 50 may be coupled to positive antenna feed terminal 54 and ground transmission line conductor 52 may be coupled to ground antenna feed terminal 56.

In the illustrative configuration of FIG. 4 in which the conductive lines of transmission line 48 are coupled to the feed terminals 54 and 56 of antenna element L1, antenna resonating element L2 may be indirectly fed. Antenna element L1 may be directly fed using feed terminals 54 and 56. Directly fed element L1 may indirectly feed radio-frequency antenna signals to element L2 via near field coupling 78. If desired, antenna resonating element L2 may be directly fed by coupling transmission line 48 across pairs of terminals in element L2. Indirect feeding arrangements for loop antenna structures 44 may sometimes be described herein as an example. This is, however, merely illustrative. In general, any suitable feeding arrangement may be used for feeding antenna 44 if desired.

Loop antenna structures 44 may be formed using conductive antenna resonating element structures such as metal traces on a dielectric carrier. The dielectric carrier may be formed from glass, ceramic, plastic, or other dielectric material. As an example, the dielectric carrier may be formed from a plastic support structure. The plastic support structure may, if desired, be formed from a hollow speaker box enclosure that serves as a resonant cavity for a speaker driver.

The conductive structures that form loop antenna structures 44 may include wires, metal foil, conductive traces on printed circuit boards, portions of conductive housing structures such as conductive housing walls and conductive internal frame structures, and other conductive structures.

As shown in FIG. 4, antenna resonating element L2 may have a longitudinal axis such as axis 74. Axis 74 may sometimes be referred to as the longitudinal axis of loop distributed loop antenna structures 44 and/or the longitudinal axis of a dielectric carrier used to support conductive loop structures. Loop antenna structures 44 may have resonating element conductive structures that are spread out ("distributed") along longitudinal axis 74 of loop L2. For example, conductive structures 72 in resonating element loop L2 of antenna structures 44 may include a strip or sheet of conductor that has a first dimension that is wrapped around longitudinal axis 74 and a second dimension that extends along the length of longitudinal axis 74. Conductive structures 72 may wrap around axis 74. During operation, antenna currents can flow within the strip-shaped conductive material of loop L2 around axis 74. In effect, conductive material 72 will form a wide strip of conductor in the shape of a loop that is characterized by a perimeter P. The antenna currents flowing in loop L2 tend to wrap around longitudinal axis 74. When installed within device 10, longitudinal axis 74 of antenna element L2 may extend parallel to an adjacent edge of housing 12 in electronic device 10 (as an example).

It may be desirable to form distributed loop antenna structures 102 from conductive structures that exhibit a relatively small dimension P. In a loop without any break along periphery P, the antenna may resonate at signal frequencies where the signal has a wavelength approximately equal to P. In compact structures with unbroken loop shapes, the frequency of the communications band covered by antenna loop L2 may therefore tend to be high. By incorporating a gap or other capacitance-generating structure into the loop, a capacitance C can be introduced into antenna loop L2. Conductive material 72 may also be configured to form one or more inductor-like paths to introduce inductance L into antenna loop L2 if desired. Material 72 may, for example, be configured to produce segments of conductive material 72 within loop L2 that serve as inductance-producing wires. With the presence of capacitance C and inductance L within the perimeter of loop antenna element L2, the resonant frequency of antenna element L2 may be reduced to a desired frequency of operation without enlarging the value of perimeter P.

Indirect feed element L1 may be formed from conductive structures 70. Conductive structures 70 may include a strip or sheet of conductor that winds around longitudinal axis 76. The width of conductor 70 may be less than the width (e.g., second dimension) of distributed loop L2. In order to ensure efficient near field coupling 78 between loops L1 and L2, longitudinal axis 76 of feed element L1 may be oriented at a substantially perpendicular angle with respect to longitudinal axis 74 of distributed loop element L2. For example, axis 76 may be oriented at 90 degrees with respect to axis 74 or at an angle between 75 and 105 degrees with respect to axis 74. Loop element L1 may, for example, be placed at a distance from element L2 that is less than or equal to a wavelength of operation of antenna 44. During operation, currents flow through loop L1 between feed terminals 54 and 56 (e.g., in a loop path around axis 76). These currents electromagnetically induce currents to flow through loop L2 via near field coupling 78.

During operation, both elements L1 and L2 may contribute to the overall performance of antenna structures 44. For example, at lower frequencies such as frequencies in a low band such as a 2.4 GHz frequency band, antenna resonating element L2 may serve as the primary radiating element in structures 44 and antenna resonating element L1 serves as a secondary radiating element in structures 44. At higher frequencies such as frequencies in high band such as a 5.0 GHz frequency band, antenna resonating element L1 may serve as the primary radiating element in antenna structures 44 and antenna resonating element L2 serves as a secondary radiating element. This example is merely illustrative and, in general, each loop element may provide any desired contribution to antenna performance in any desired band.

Figure 5:
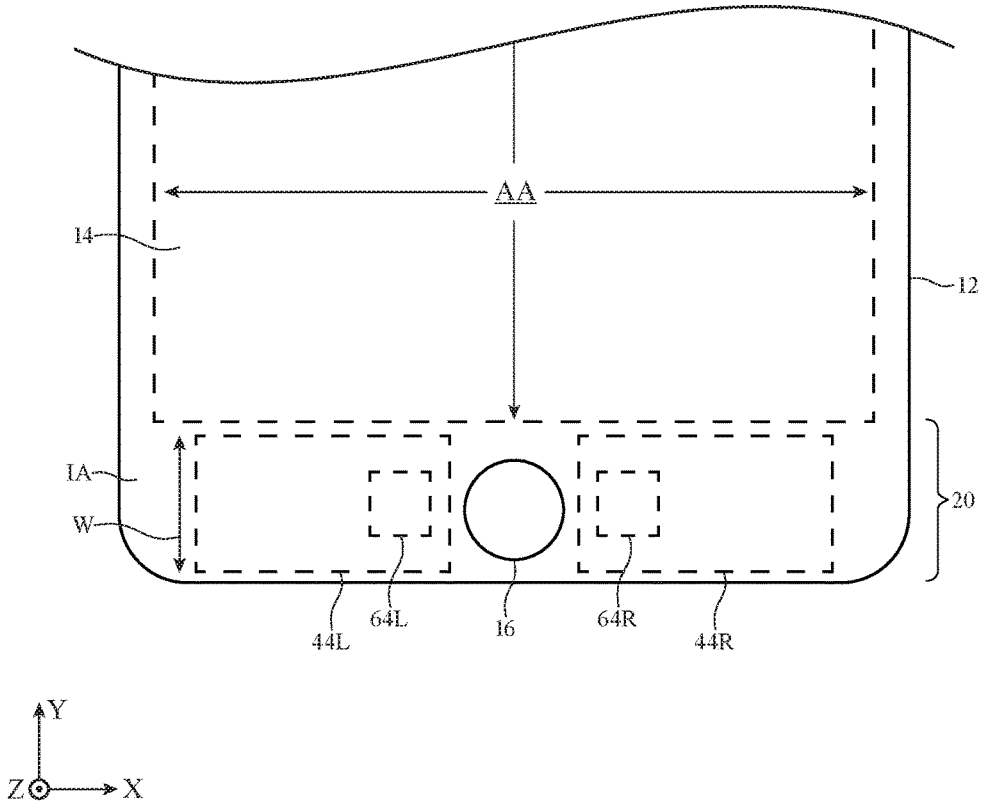
FIG. 5 is a top view of an illustrative antenna mounted in a lower portion of an electronic device housing beneath an inactive area of a display in accordance with an embodiment.

FIG. 5 is a front view of device 10 showing how antenna 44 may be integrated within housing 12 of device 10. As shown in FIG. 5, one or more antennas 44 may be formed under inactive area IA of display 44 within region 20.

In the example of FIG. 5, two antennas 44 are formed within region 20. For example, a left antenna 44L may be formed on a first side of button 16 whereas a right antenna 44R is formed on a second side of button 16. Left and right antennas 44 may be identical antennas, mirrored antennas, or may be different antennas. If desired, some of antennas 44L or 44R may be formed under button 16.

In order to provide as large an active area AA for display 14 as possible, the width W occupied by inactive area IA of display 14 may be reduced. This reduces the amount of space available for antennas 44 within region 20. In order to conserve the space required for inactive area IA (e.g., so that more area on device 10 is available for active area AA), audio components such as speaker drivers 64 may be mounted within antennas 44 (e.g., a first speaker driver 64L may be mounted within left antenna 44L whereas a second speaker driver 64R is mounted within right antenna 44R). In this scenario, each antenna 44 may define an acoustic speaker cavity that is driven by speaker driver 64 to generate audio signals that are transmitted out of device 10 through speaker holes 8. The example of FIG. 5 is merely illustrative and, in general, any desired number of antennas 44 may be formed at any desired location within region 20 (e.g., two antennas, one antenna, or more than two antennas 44 may be formed in region 20). If desired, speaker driver 64 may be formed within one or none of antennas 44L and 44R. Driver 64 may be located near and end of antenna 44 that is adjacent to button 16 or at any other desired location.

In order to further conserve the amount of space required for inactive area IA (e.g., to maximize the space available for active area AA), the size of antennas 44 may be reduced, thereby reducing width W. However, if care is not taken, reducing width W and the corresponding size of antennas 44 can undesirably inhibit the efficiency bandwidth of antennas 44.

Figure 6:
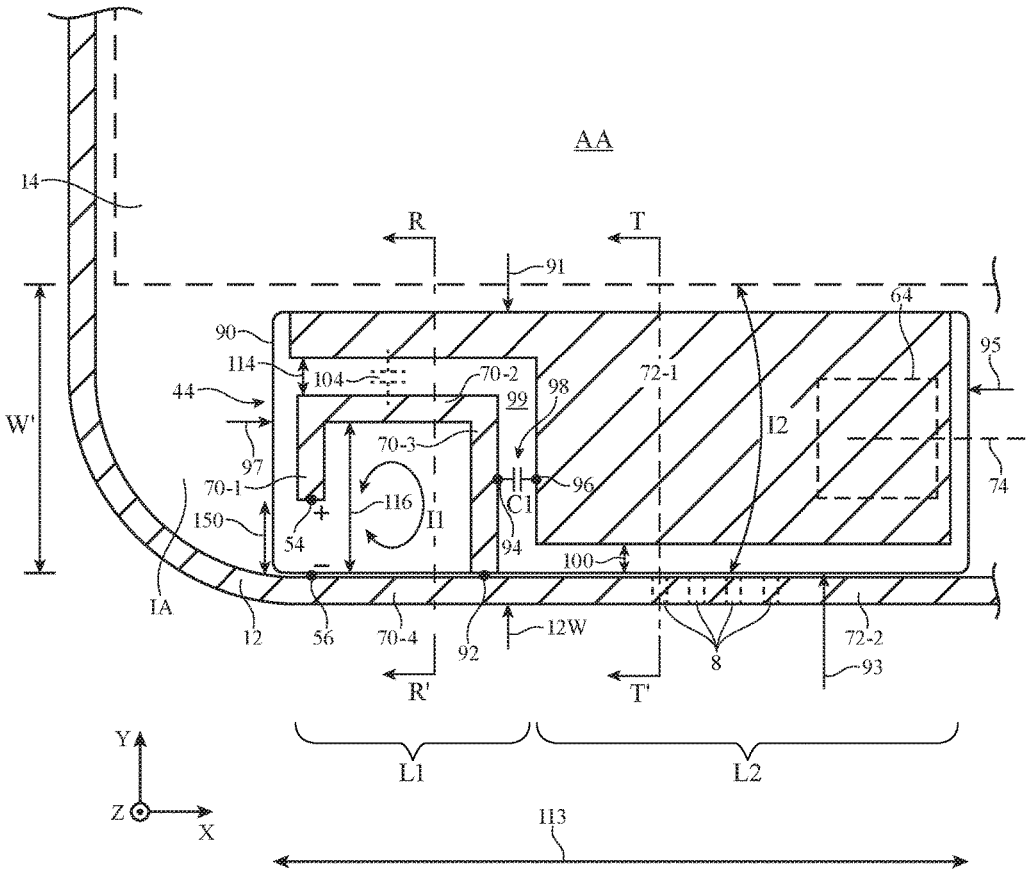
FIG. 6 is a top view of an illustrative indirectly-fed distributed loop antenna formed partially from an electronic device housing in accordance with an embodiment.

FIG. 6 is a front view of device 10 showing how antennas 44 may be integrated within housing 12 of device 10. As shown in FIG. 6, antenna 44 (e.g., an antenna such as antenna 44L of FIG. 5) may be formed under inactive area IA of display 14 near the edge of device 10.

Antenna feeding element loop L1 and distributed loop antenna resonating element L2 may be formed from metal, conductive materials that contain metal, or other conductive substances. For example, antenna feeding element L1 may be formed from conductive structures 70 (e.g., as shown in FIG. 4). Distributed loop antenna element L2 may be formed from conductive structures 72. In order to further reduce the space occupied by antenna 44, part of the conductive structures 70 that form loop feeding element L1 and part of the conductive structures 72 that form distributed loop antenna resonating element L2 may be formed from conductive housing 12 (e.g., from sidewall 12W of housing 12).

One or more support structures such as support structures 90 may be used to support conductive structures 70 and 72. Support structures 90 may be formed from a dielectric such as plastic. In one suitable arrangement, support structures 90 may include a single elongated dielectric carrier that extends across the width 113 of antenna 44. If desired, support structures 90 may include multiple separate carrier structures. Conductive structures 70 in feed element L1 may include a first portion 70-1, a second portion 70-2, and a third portion 70-3 that are formed on top surface 99 of dielectric carrier 90. Conductive structures 72 in distributed loop antenna resonating element L2 may include a first portion 72-1 formed on top surface 99 of dielectric carrier 90. Conductor 72-1 may extend down and over side 91 of carrier 90 (e.g., the side of carrier 90 that opposes housing sidewall 12W). If desired, conductive structures 72-1, 70-1, 70-2, and/or 70-3 may be formed from metal traces that are in direct contact with carrier 90. For example, conductive structures 72-1, 70-1, 70-2, and/or 70-3 may be patterned or etched directly onto carrier 90. In another suitable arrangement, conductive structures 72-1, 70-1, 70-2, and/or 70-3 may be formed from metal traces on a flexible printed circuit board that is placed over carrier 90. If desired, conductive structures 72-1, 70-1, 70-2, and/or 70-3 may be formed from stamped pieces of sheet metal that are placed on top surface 99 of carrier 90. The stamped sheet metal used to form conductive structure 72-1 may extend over side 91 of carrier 90, for example.

Conductive structures 70 of feed element L1 may include a portion 70-4 of conductive housing sidewall 12W. Conductive structures 72 in distributed loop antenna resonating element L2 may include a portion 72-2 of conductive housing wall 12W. Conductive structures 72 may also include a portion of the metal rear wall of device 10, which is not shown in FIG. 6 for the sake of clarity. Carrier 90 may be placed within device 10 so that housing sidewall 12W covers side (surface) 93 of dielectric carrier 90. The opposing side 91 of carrier 90 may be substantially, partially, or completely covered by conductive structure 72-1. The bottom side of carrier 90 (i.e., the side of carrier 90 opposing top side 99) may be covered by the metal rear wall of housing 12. Left side 97 and right side 95 of carrier 90 may be covered with other conductive structures or may be free from conductive structures.

By forming part of feed loop L1 and part of distributed loop antenna resonating element L2 from conductive portions of housing 12, the total space occupied by antenna 44 in device 10 may be reduced relative to scenarios where the antenna is formed separately from housing 12. For example, antenna 44 may occupy a width W' within device 10 that is much smaller than when antenna 44 is formed separately from housing 12. By reducing the width W' occupied by antenna 44, display 14 may have a maximal active area AA and a minimal inactive area IA, thereby maximizing the viewable size of the display on the device. Width W' may be, for example, 5 mm, less than 5 mm, 9 mm, between 5 and 9 mm, between 9 and 15 mm, more than 15 mm, or any other desired length.

Dielectric carrier 90 may be a hollow carrier that includes a cavity that is filled with air. Speaker driver 64 may be placed within the cavity defined by dielectric carrier 90. Speaker driver 64 may, for example, include speaker coils, magnets, shunt structures, diaphragm structures, or any other desired speaker driver components. Speaker driver 64 may be driven using electrical audio signals and may convert the electrical audio signals into sound waves. The sound waves may be mechanically amplified by the cavity within dielectric carrier 90. Openings within dielectric carrier 90 may be aligned with speaker openings 8 in housing sidewall 12W so that the audio signals can escape out of device 10 and be heard by a user.

In one suitable arrangement, antenna feed element loop traces 70-1, 70-2, and 70-3 may be mounted in a ground cavity (i.e., loop L1 may be mounted in a cavity-backed antenna environment). For example, metal structure 72-1, housing sidewall 12W, a metal housing rear wall, and optionally conductive structures on sides 97 and 95 may define a conductive cavity that backs feed L1. By placing traces 70-1, 70-2, and 70-3 within the conductive cavity, feed element L1 can be decoupled from surrounding metal structures in device 10 (e.g., the performance of loop L1 will not be affected by variations in the distance between carrier 90 and nearby conductive structures).

Loop feeding element L1 may be directly fed by transmission line 48 using an antenna feed that includes positive (+) antenna feed terminal 54 and ground (−) antenna feed terminal 56. For example, signal conductor 50 (e.g., a signal conductor of a coaxial cable or other transmission line structure) and ground conductor 52 (e.g., a ground conductor or outer braid of a coaxial cable or other transmission line structure) of transmission line 48 (FIG. 3) may be in direct contact with conductive structures 70 of feeding loop L1. In the example of FIG. 6, positive antenna feed terminal 54 is located at a bottom edge of conductive trace 70-1 whereas ground antenna feed terminal 56 is located on an inner edge of housing sidewall 12W (e.g., portion 70-4 of loop feed L1). If desired, feed terminal 54 may be placed at another location on conductive portion 70-1. Feed terminals 54 and 56 may be separated by gap 150 (e.g., a portion of the surface of carrier 90 that is free from conductive material).

Conductive trace 70-3 of feed element L1 may be coupled to housing sidewall 12W at location 92. For example, trace 70-3 may be directly and electrically connected to sidewall 12W using solder, welds, conductive adhesive, conductive fastening structures such as screws, or any other desired structures that form a direct electrical connection between trace 70-3 and sidewall 12W. Portion 70-4 of feed L1 that is formed using housing sidewall 12W may include the portion of housing sidewall 12W that extends between connecting location 92 and ground feed terminal 56. Conductive trace 70-2 of feed element L1 may extend from an edge of portion 70-1 that opposes feed terminal 54 to the edge of trace 70-3 that opposes housing sidewall 12W. For example, trace 70-1 may extend substantially parallel to trace 70-3 whereas trace 70-2 extends substantially perpendicular to traces 70-1 and 70-3. Trace 70-2 may be separated from housing sidewall 12W by gap 116 and may, if desired, extend substantially parallel to housing sidewall 12W. In the example of FIG. 6, trace 70-2 is longer than trace 70-1 and trace 70-3 is longer than trace 70-2. This example is merely illustrative and, in general, traces 70-1, 70-2, and 70-3 may have any desired relative lengths, shapes, relative orientations, and perimeters.

During operation, currents in structure L1 may circulate within structure L1 as indicated by loop I1 (e.g., current I1 may flow between feed terminals 54 and 56 over conductive portions 70-1, 70-2, 70-3, and 70-4 in a loop pattern). Feed element L1 may be separated from conductor 72-1 of distributed loop antenna resonating element L2 by gap 114. Gap 114 may be, for example, small enough to ensure satisfactory near field coupling between feed element L1 and resonating element L2 (e.g., as shown by coupling 78 in FIG. 4). If desired, gap 114 may be dimensioned to allow conductors 70-2 and 72-1 to exhibit a desired parasitic capacitance 104 (e.g., to optimize antenna efficiency and bandwidth). Gap 114 may have the same width between trace 70-2 and conductor 72-1 as between trace 70-3 and conductor 72-1. In another suitable arrangement, the width of gap 114 between trace 70-2 and conductor 72-1 may be different than between trace 70-3 and conductor 72-1. Gap 115 may have a uniform width across its length or may have varying widths. By near field coupling feed element L1 to resonating element L2, currents I1 that are directly fed onto element L1 may induce currents I2 to flow on resonating element L2. Currents I2 induced on resonating element L2 may flow through conductor 72-1, the rear metal wall of housing 12, and through housing sidewall 12W at portion 72-1. Currents I1 and I2 may resonate with high efficiency to transmit and receive wireless radio-frequency signals for antenna 44 in one or more frequency bands.

Conductor 72-1 of distributed loop antenna resonating element L2 may be separated from housing sidewall 12W (e.g., from portion 72-2 of element L2) by gap 100. Gap 100 may extend from an end of gap 114 adjacent to feed segment 70-3 to the end of antenna 44 adjacent to end 95 of substrate 90. Gap 100 may be smaller than gap 116, for example. Gap 100 interposed in the loop of structure L2 may establish a desired capacitance within the loop of structure L2 (e.g., gap 100 may establish capacitance C of FIG. 4). By distributing gap 100 between conductor 72-1 and housing 12W across the width of element L2, current hotspots along the length of element L2 may be reduced (e.g., current I2 may spread evenly across the width of element L2). This may reduce the likelihood of emitting excessive signal radiation into the body of a user of device 10 (e.g., thereby satisfying requirements on the absorption of electromagnetic energy by the body of a user of wireless electronic devices). This may also reduce the sensitivity of antenna 44 to detuning or other effects caused by the presence of a user's body near or in contact with the side of housing 12.

Gap 100 between conductor 72-1 and housing sidewall 12W and gap 114 between feed conductor 70 and conductor 72-1 may, for example, form a continuous slot structure (e.g., an open slot structure having a first open end adjacent to side 97 defined by conductor 70-2 and conductor 72-1 and a second open end adjacent to side 95 defined by conductor 72-1 and sidewall 12W). In general, the continuous slot defined by gaps 114 and 100 may have any desired shape.

The overall size (e.g., resonant length) of elements L1 and L2 may determine the minimum frequency achievable by antenna 44. For example, larger sizes for elements L1 and L2 may support longer resonating wavelengths and thus lower resonating frequencies than smaller sizes for elements L1 and L2. If desired, capacitor 98 may be coupled between feed element L1 and distributed loop antenna element L2. For example, capacitor 98 may have a first terminal 94 coupled to conductive structure 70-3 and a second terminal 96 coupled to conductor 72-1. Capacitor 98 may be, for example, a discrete capacitor such as a surface mounted capacitor, or any other desired capacitive component. Capacitor 98 may have a selected capacitance C1. As an example, capacitance C1 may be 0.6 pF, between 0.3 pF and 0.9 pF, greater than 0.9 pF, less than 0.3 pF, or any other desired capacitance. The particular value of capacitance C1 may depend on the frequency band of interest.

Capacitor 98 may serve to shift the resonant frequency of antenna 44 to a lower frequency than would otherwise be possible given the physical length of elements L1 and L2 (e.g., to a resonant frequency that is less than the minimum possible resonant frequency allowed by the dimensions of L1 and L2). For example, the frequency of antenna 44 may be inversely proportional to the capacitance between feed element L1 and distributed loop L2. Forming capacitor 98 in gap 114 may increase the capacitance between elements L1 and L2, thereby decreasing the frequency of antenna 44 to a lower frequency than would otherwise be possible given the size of elements L1 and L2. In this way, forming capacitor 98 may allow the size of elements L1 and/or L2 to be reduced, while still maintaining a desired frequency of operation. This may allow the size of antenna 44 and thus width W' to be further reduced, thereby maximizing the possible size of active display area AA in device 10 without sacrificing antenna performance at a desired communications frequency.

The example of FIG. 6 is merely illustrative. In general, conductor 72-1 may have any desired shape, perimeter, or size. Gap 100 may have a meandering shape or any other desired shape (e.g., as defined by the shape of the lower edge of conductor 72-1). If desired, more than one capacitor 98 may be coupled between feed loop L1 and resonating element loop L2. Capacitor 98 may, if desired, be a switchable capacitor that is switched into or out of use. Capacitor 98 may be connected between trace 70-3 and conductor 72-1 at other locations across gap 114. If desired, capacitor 98 may be coupled between trace 70-2 and conductor 72-1 or between trace 70-1 and conductor 72-1. In the example of FIG. 6, speaker driver 64 is placed within dielectric carrier 90 at an opposing side from feed L1 (e.g., driver 64 is located adjacent to side 95 whereas feed L1 is adjacent to side 97). This may minimize interference between driver 64 and feed L1, for example. However, in general, speaker driver 64 may be placed at any desired location within carrier 90.

If desired, a similar structure to that shown in FIG. 6 may be used to form antenna 44R of FIG. 5. In the example of FIG. 6, element L1 is adjacent to side 97 whereas element L2 is adjacent to side 95 of carrier 90. If desired, element L1 may be formed adjacent to side 95 whereas element L2 is formed adjacent to side 97 (e.g., the arrangement shown in FIG. 6 may be mirrored about the y-axis) or element L1 may be formed at any other desired location along the length of antenna 44 (e.g., along the x-dimension of FIG. 6, so long as element L1 is separated from element L2 by gap 114). In the example of FIG. 6, conductor 72-1 of distributed loop element L2 may extend to side 97 of carrier 97 (e.g., so that the entire length of segment 70-2 is separated from conductor 72-1 by gap 114). If desired, conductor 72-1 may extend parallel to only a portion of segment 70-2 or may extend past segment 70-2. In the example of FIG. 6, feed element L1 is arranged in a half-loop configuration (e.g., a loop configuration where a portion of the loop is formed using grounded housing structures 12). In general, feeding element L1 may have any desired configuration (e.g., element L1 may be an inverted-F element, monopole element, dipole element, full loop element, or any other desired element that is formed at least partially from housing 12 and that indirectly feeds element L2). In an example where element L1 is an inverted-F element, the ground plane of the inverted-F element may be formed from housing portion 70-4 of sidewall 12W. Two or more of segments 70-1, 70-2, and 70-3 of feed element L1 may each have the same width, or each of segments 70-1, 70-2, and 70-3 may have different respective widths. The width of segments 70-1, 70-2, and 70-3 may be the same as or less than the width (thickness) of housing sidewall 12W.

Figure 7:
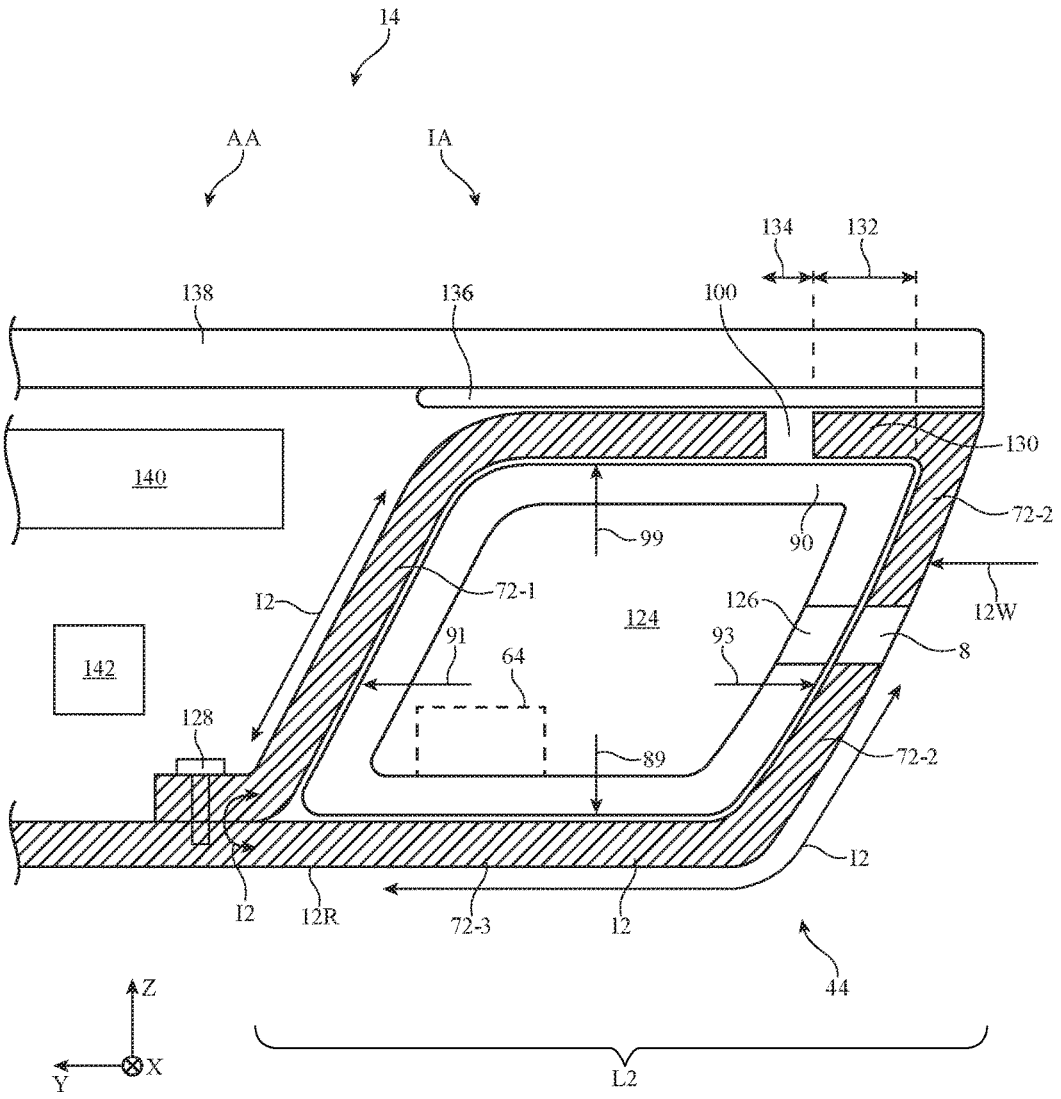
FIGS. 7 and 8 are cross-sectional side views of an illustrative indirectly-fed distributed loop antenna formed partially from an electronic device housing in accordance with an embodiment.

FIG. 7 is a cross-sectional side view of a portion of electronic device 10 (e.g., taken along line TT' of FIG. 6) showing how distributed loop antenna resonating element L2 may include a portion of metal housing 12. As shown in FIG. 7, electronic device 10 may have a display such as display 14 that has an associated display module 140 and display cover layer 138. Display module 140 may be a liquid crystal display module, an organic light-emitting diode display, or other display for producing images for a user. Display module 140 may include touch sensitive components in scenarios where display 14 is a touch-sensitive display, for example. Display cover layer 138 may be a clear sheet of glass, a transparent layer of plastic, or other transparent member. If desired, display cover layer 138 may form a portion of display module 138.

In active area AA, an array of display pixels associated with display structures such as display module 140 may present images to a user of device 10. In inactive display border region IA, the inner surface of display cover layer 138 may be coated with a layer of black ink or other opaque masking layer 136 to hide internal device structures from view by a user. Antenna 44 may be mounted within housing 12 under opaque masking layer 136. During operation, antenna signals may be transmitted and received through a portion display cover layer 138. Forming antenna 44 under inactive region IA of display 14 may allow antenna 44 to transmit and receive radio-frequency signals through display cover layer 138 without the signals being blocked or otherwise impeded by active circuitry in display module 140. Other components 142 may be formed within housing 12 (e.g., components such as printed circuit boards, transceiver circuitry for antenna 44, any other desired components used for implementing storage and processing circuitry 22 and/or input-output circuitry 24 (FIG. 2), or any other desired components).

As shown in FIG. 7, dielectric carrier 90 may be a plastic substrate having a hollow cavity 124. Cavity 124 may be filled with air or other dielectric materials. Speaker driver 64 may be placed within cavity 124. Dielectric carrier 90 may have openings 126. Openings 126 may be aligned with openings 8 in housing sidewall 12W. Sound produced by speaker driver 64 may pass through opening 126 and opening 8 so that the sound may be heard by a user of device 10.

Housing 12 of device 10 may have a rear housing wall 12R (e.g., a surface of device 10 that opposes display cover layer 138 may be defined by rear housing wall 12R). Housing rear wall 12R and housing sidewall 12W (or at least the portion of walls 12R and 12W that are in contact with dielectric carrier 90) may be formed from metal. Housing sidewalls 12W may extend from rear housing wall 12R towards display cover layer 138. Sidewall 93 of dielectric carrier 90 may be substantially or completely covered by housing sidewall 12W. The top side of housing sidewall 12W may provide mechanical support for display cover layer 138. If desired, housing sidewall 12W may include an inwardly-extending ledge portion 130. Ledge 130 may support display cover layer 138 (e.g., ledge 130 may enhance the structural support for display cover layer 138 provided by housing sidewall 12W). Ledge 130 may be formed over or on top surface 99 of dielectric carrier 90. Ledge 130 may have a width 132. If desired, ledge 130 may be omitted (e.g., width 132 may be equal to zero mm).

Conductive structure 72-1 of distributed loop antenna resonating element L2 may be formed over (e.g., wrapped around) top surface 99 and sidewall 91 of dielectric carrier 90. In one suitable arrangement, conductive structure 72-1 is formed using stamped sheet metal that is placed over sides 99 and 91 of dielectric carrier 90. If desired, adhesive or other structures may be used to hold conductor 72-1 in place on dielectric carrier 90. Conductive sheet 72-1 may be separated from housing sidewall 12W (e.g., from ledge 130 in scenarios where width 132 is non-zero) by gap 100 (e.g., as shown in FIG. 6). Conductive sheet 72-1 may be electrically coupled to (e.g., in direct electrical contact with) housing rear wall 12R adjacent to side 91 of dielectric carrier 90. If desired, fastening structures 128 may be used to secure conductive sheet 72-1 to housing rear wall 12R. Fastening structures 128 may ensure that a reliable mechanical and electrical connection is provided between conductive sheet 72-1 and housing rear wall 12R. Fastening structures may be conductive fastening structures such as conductive screws, conductive pins, conductive adhesive, conductive foam structures, conductive tape, solder, welds, or other conductive fastening structures. Multiple fastening structures may be used at multiple points along the length of carrier 90 (e.g., along the x-dimension of FIG. 6) if desired. For example, screws may be placed at regular or irregular intervals along sheet 72-1 to mechanically and electrically secure sheet 72-1 to rear wall 12R along the length of antenna 44.

Antenna current I2 induced on distributed loop antenna resonating element L2 by feed element L1 (not shown in FIG. 7) may flow through conductive sheet 72-1, conductive fastener 128, a portion 72-3 of housing rear wall 12R, and portion 72-2 of housing sidewall 12W (e.g., in a loop through conductive structures 70 of resonating element L2). By forming two of the four sides of loop 70 of distributed loop antenna resonating element L2 using housing 12 and by forming gap 100 between conductive sheet 72-1 and housing sidewall 12W, antenna 44 may occupy a smaller space within device 10 relative to scenarios where the antenna is separate from housing 12 (e.g., without sacrificing antenna performance at the resonant frequencies of interest).

In the example of FIG. 7, carrier 90 has a polygonal cross-sectional shape (e.g., side 91, 93, 99, and 89 are substantially planar). This is merely illustrative. If desired, some or all of each of sides 91, 99, 93, and/or 89 may be curved. In general, sides 89 and 93 of carrier 90 may conform to (e.g., accommodate, extend parallel to, or abut) the shape of housing sidewall 12W and housing rear wall 12R. Side 93 of carrier 90 and housing sidewall 12W may be substantially parallel to side 91 of carrier 90 or side 91 and conductor 72-1 may be oriented at a non-parallel angle with respect to side 93 and sidewall 12W. Similarly, side 99 of carrier 90 (and the top portion of conductor 72-1) may be substantially parallel to bottom side 89 of carrier 90 and housing rear wall 12R or conductor 72-1 and side 99 may be oriented at a non-parallel angle with respect to side 89 and rear wall 12R. Side 91 and conductor 72-1 may be oriented at a non-zero angle with respect to the z-axis in FIG. 7 (e.g., at a non-vertical angle) to provide more space to accommodate components 142 and display module 140, or may be oriented at a vertical angle if desired. The cross section of carrier 90 may have more than four sides if desired. In general, carrier 90, conductor 72-1, housing sidewall 12W, and housing rear wall 12R may have any desired shapes.

Figure 8:
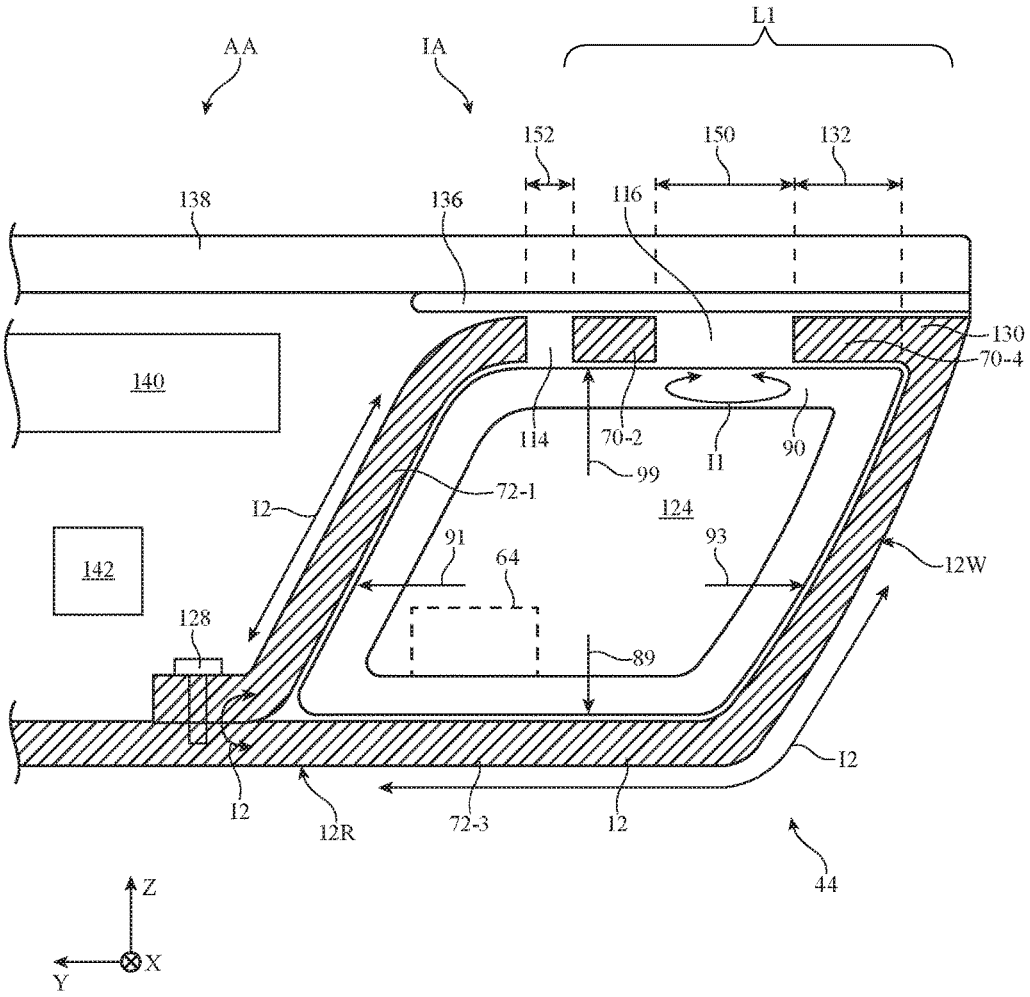

FIG. 8 is a cross-sectional side view of a portion of electronic device 10 (e.g., as taken along line RR' of FIG. 6) showing how loop feed element L1 may include a portion of metal housing 12. Descriptions of many of the components shown in FIG. 8 are provided in connection with FIG. 7 and are not repeated for the sake of brevity. As shown in FIG. 8, loop feed element L1 may include metal trace 70-2 and a portion 70-4 of housing sidewall 12W adjacent to top surface 99 of carrier 90. In scenarios where ledge 130 is formed (e.g., when width 132 is non-zero), ledge 130 may form portion 70-4 of loop feed element L1.

In the example of FIG. 8, gap 116 separating trace 70-2 and housing portion 70-4 may have a width 150. Width 150 may be greater than width 152 of gap 114 between trace 70-2 and metal sheet 72-1 (e.g., the stamped metal sheet used to form distributed loop antenna resonating element L2). Width 150 of gap 116 may be greater than width 132 of ledge 130. This is merely illustrative. If desired, width 150 may be less than or equal to width 152 and/or may be less than or equal to width 132.

Radio-frequency antenna signals are directly fed to feed element L1 over antenna feed terminals 54 and 56 (FIG. 6). These antenna signals form currents I1 that flow on conductive loop structures 70 of feed element L1. Currents I1 may induce currents I2 to flow through distributed loop antenna resonating element L2 (e.g., through conductor 72-1, portion 72-3 of rear wall 12R, and portion 72-2 of sidewall 12W (FIG. 7)).

Figure 9:
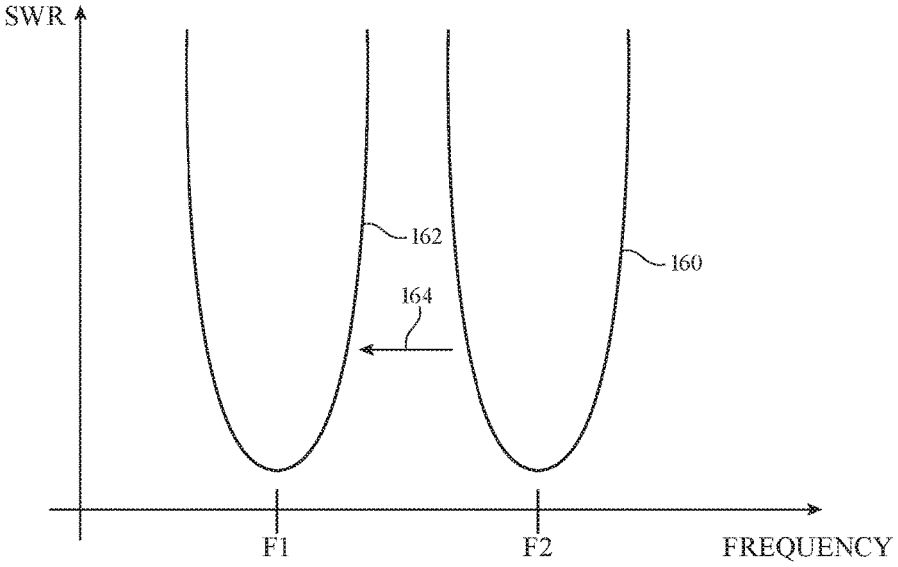
FIG. 9 is a graph of antenna performance (standing wave ratio SWR) plotted as a function of operating frequency that shows how a capacitor may adjust the resonance of an antenna of the type shown in FIGS. 6-8 in accordance with an embodiment.

FIG. 9 is a graph showing how capacitor 98 of antenna 44 may affect the performance of antenna 44. As shown in FIG. 9, antenna performance (standing wave ratio) is plotted as a function of frequency. Curve 160 shows how antenna 44 may exhibit a resonance at frequency F2 in the absence of capacitor 98 (e.g., when capacitor 98 is switched out of use or when capacitor 98 is omitted from antenna 44). Curve 162 shows how antenna 44 may exhibit a resonance at frequency F1 that is lower than frequency F2 in the presence of capacitor 98 (e.g., when capacitor 98 is switched into use or when capacitor 98 is formed within antenna 44). Resonance 160 may, for example, be at least partially determined by the shape (e.g., overall size) of antenna 44. For example, the size of antenna 44 may provide a lower limit on the possible resonant frequency of antenna 44 (e.g., lower resonances may not be possible without increasing the size of antenna 44). However, forming capacitor 98 between feed element conductor 70 and distributed loop antenna resonating element conductor 72-1 may effectively shift the resonance of antenna 44 to lower frequency 162 as shown by arrow 164 (e.g., to a frequency lower than what would otherwise be possible given the size of antenna 44).

As an example, frequency F2 may be 3.3 GHz. It may be desirable to provide a resonance at 2.4 GHz such as to cover a wireless local area network communications band at 2.4 GHz. However, the size of antenna 44 may make it difficult to achieve such a low frequency resonance (e.g., without undesirably increasing the size of antenna 44 and thus the size of inactive display portion IA). By forming capacitor 98 in antenna 44, the resonance of antenna 44 may be shifted to a frequency F1 of 2.4 GHz without the need to increase the physical size or perimeter of antenna 44. In this way, antenna 44 may cover a desired 2.4 GHz wireless local area network frequency band while having a small size that would otherwise be limited to higher frequencies such as 3.3 GHz. This may allow further reduction to width W' (FIG. 6) and a corresponding maximization of the size of active display area AA without reducing antenna performance in the frequency band of interest. The example of FIG. 9 is merely illustrative. In general, any desired frequency bands may be covered by antenna 44. If desired antenna 44 may simultaneously cover multiple different frequency bands. For example, antenna 44 may resonate in both 2.4 GHz and 5.0 GHz frequency bands (e.g., 2.4 GHz and 5.0 GHz wireless local area network communications bands).

In such scenarios, the lower frequency band covered by antenna 44 may sometimes be referred to as a lower frequency band LB (e.g., 2.4 GHz) whereas the higher frequency band covered by antenna 44 may sometimes be referred to as a higher frequency band HB (e.g., 5.0 GHz). During operation, both elements L1 and L2 may contribute to the overall performance of antenna structures 44. For example, at lower frequencies such as frequencies in low band LB, antenna resonating element L2 may serve as the primary radiating element in structures 44 (e.g., because element L2 has a much larger size than feeding element L1) whereas antenna resonating element L1 serves as a secondary radiating element in structures 44. At higher frequencies such as frequencies in high band HB, antenna feeding element L1 may serve as the primary radiating element in antenna structures 44 and antenna resonating element L2 may serve as a secondary radiating element.

Figure 10:
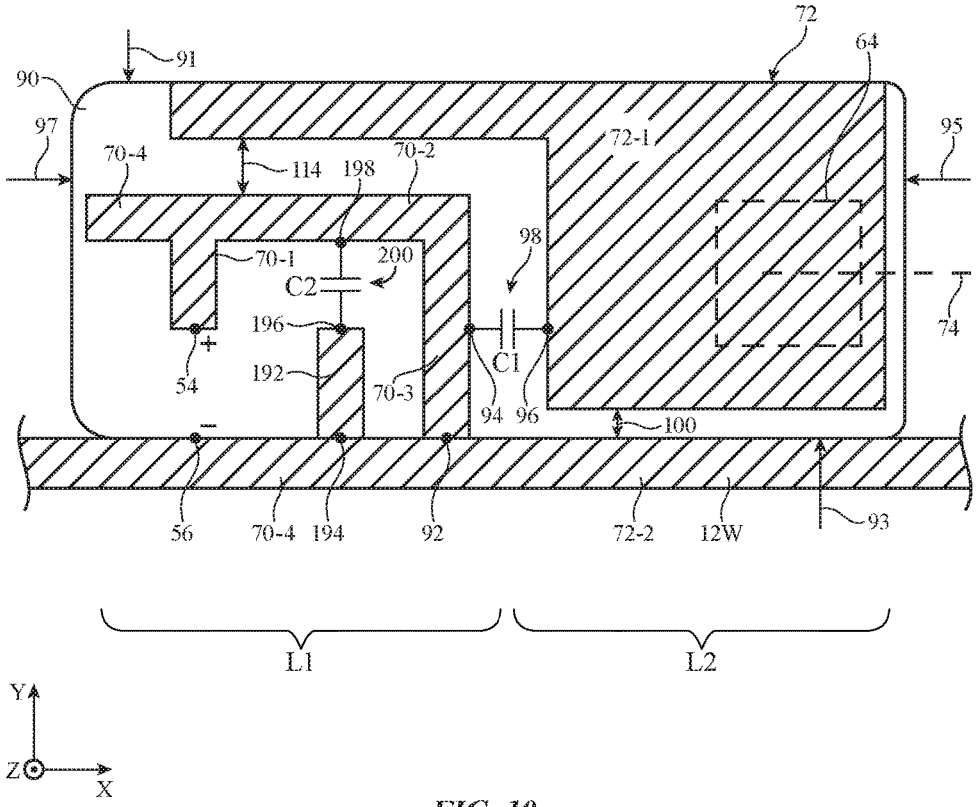
FIG. 10 is a top view of an illustrative distributed loop antenna having a feeding element with an extended portion for handling high band communications in accordance with an embodiment.

If desired, antenna feed element L1 may include additional structures that enhance the efficiency of antenna 44 in a second frequency band (e.g., high band HB). FIG. 10 is a front view showing how feed element L1 may include structures for enhancing coverage of a second frequency band for antenna 44. As shown in FIG. 10, antenna feed element L1 may include an extended conductive segment 70-4. Conductive segment 70-4 may extend from segment 70-2 (and perpendicularly from an end of directly fed segment 70-1) adjacent to edge 97 of dielectric carrier 90. Segment 70-4 may adjust the resonant length of feed element L1 so that element L1 has increased antenna efficiency in the second band. This may allow element L1 to efficiently transmit and receive radio-frequency signals for antenna 44 in the second band (e.g., 5.0 GHz) while also serving as a feed element for distributed loop element L2 (e.g., so that loop L2 may serve as a primary radiating element in the first frequency band such as 2.4 GHz).

The example of FIG. 10 is merely illustrative. If desired, segment 70-4 may extend at any desired angle from segment 70-2. Segment 70-4 may have any desired width (e.g., a width that is different from the width of segment 70-2), any desired perimeter, and any desired shape (e.g., segment 70-4 may be polygonal, rectangular, triangular, curved, circular, etc.). Segment 70-4 may be formed from a conductive trace, stamped sheet metal, or any other desired conductive structure (e.g., segment 70-4 may be an extension of segments 70-2 and 70-1 or may be formed from a separate conductor that is otherwise conductively connected to segments 70-1 and 70-2).

If desired, feeding element L1 may include filtering circuitry to enhance isolation between radio-frequency signals in the first and second frequency bands. For example, element L1 may include an additional conductive segment 192. Segment 192 may be a conductive trace, stamped sheet metal, or any other desired conductor. Segment 192 may be connected to housing sidewall 12W at point 194. For example, segment 192 may be soldered to wall 12W, welded to wall 12W, formed as an integral extension to wall 12W, screwed into wall 12W, taped to wall 12W, coupled to wall 12W via conductive adhesive, etc.

Capacitor 200 may be coupled between segment 70-2 and segment 192. For example, a first terminal 198 of capacitor 200 may be coupled to segment 70-2 whereas a second terminal 196 of capacitor 200 is coupled to an end of segment 192. Capacitor 200 may have a corresponding capacitance C2. Segment 192 and segment 70-3 may exhibit desired inductances (e.g., based on the widths and lengths of segments 192 and 70-3). The inductances of segments 192 and 70-3 and the capacitance C2 of capacitor 200 may be selected to perform desired filtering operations on the antenna signals provided to feed element L1 over feed terminals 54 and 56.

Figure 11:
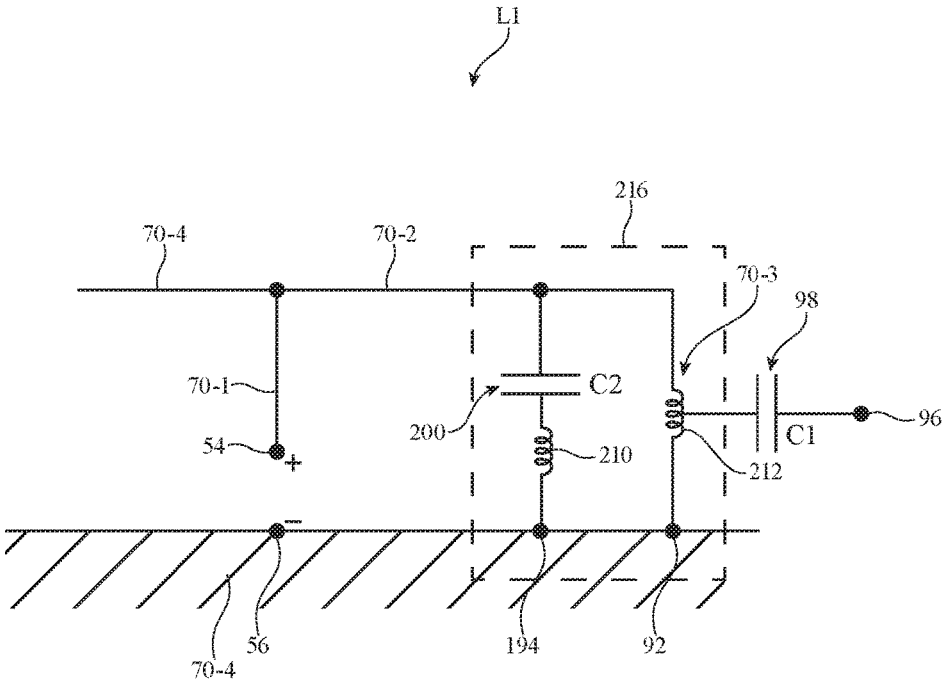
FIG. 11 is an equivalent circuit diagram of an illustrative indirect feeding element of the type shown in FIG. 10 in accordance with an embodiment.

FIG. 11 is an equivalent circuit diagram of antenna feed L1 of the type shown in FIG. 10. As shown in FIG. 10, capacitor 200 may be coupled in series with inductor 210 (e.g., an inductor formed by the inductance of segment 192 of FIG. 10) between segment 70-2 and ground (e.g., formed from a segment 70-4 of housing sidewall 12W). Inductor 212 may, for example, be formed by the inductance of segment 72-3. Capacitor 98 may be coupled between a portion of inductor 212 (e.g., a terminal 94 on segment 70-3) and distributed loop antenna resonating element L2 at terminal 96. Inductor 212 may be coupled in parallel with the series-connected capacitor 200 and inductor 210 between feed terminal 54 and ground conductor 70-4. When coupled in this way, inductor 212, inductor 210, and capacitor 200 may form filter 216 (e.g., a parallel tank circuit or parallel tank filter).

The value of capacitances C1 and C2 and the corresponding inductances of inductors 210 and 212 may be selected so that filter 216 forms a closed circuit (e.g., a zero impedance path) between feed terminal 54 and ground connections 194 and 92 at a first frequency and an open circuit (e.g., an infinite impedance path) between feed terminal 54 and ground terminals 194 and 92 at a second frequency. For example, filter 216 may form an open circuit at a high band frequency in high band HB (e.g., at 5.0 GHz) so that currents I1 at the high band frequency does not pass to through ground connections 92 and 194. This may disrupt the loop path formed by currents I1 at the high band frequency, thereby reducing near field coupling between element L1 and distributed loop L2 at the high band frequency. Segment 70-4 may exhibit a resonance at the high band frequency to transmit and receive radio-frequency signals at the high band frequency. If desired, the shape and perimeter of segment 70-4 may be selected to provide the desired resonance (e.g., segment 70-4 may affect the tuning characteristics of antenna 44 at the high band frequency).

Filter 216 may form a closed circuit at a low band frequency in low band LB (e.g., at 2.4 GHz) so that currents I1 at the low band frequency are shorted to ground (housing) segment 70-4 at locations 92 and 194. This may maintain a loop path for current I1, thereby providing high efficiency near field coupling between element L1 and element L2 at the low band frequency (e.g., so that element L1 may serve as an indirect feeding element to distributed loop element L2 that induces current I2 to flow in distributed loop element L2 at the low band frequency). The example of FIGS. 10 and 11 is merely illustrative. In general, any desired filtering circuitry may be used. If desired, filter 216 may be omitted (e.g., as shown in FIG. 6).

Figure 12:
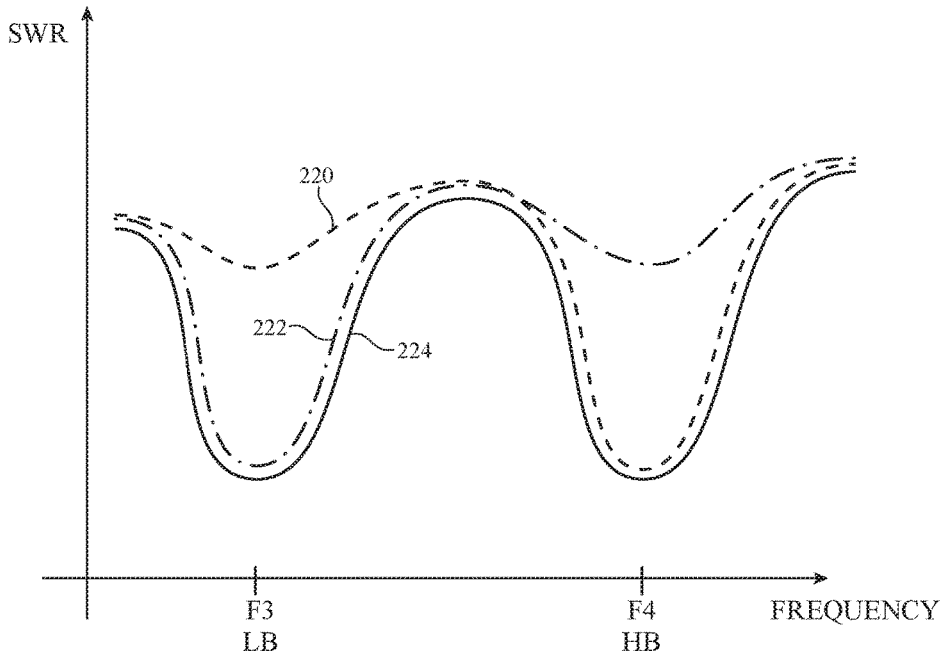
FIG. 12 is a graph of antenna performance plotted as a function of operating frequency for an illustrative antenna of the type shown in FIGS. 6-8, 10, and 11 that shows respective contributions to performance that may be made by an indirect feeding element and by a distributed loop antenna resonating element in accordance with an embodiment.

FIG. 12 is a graph in which antenna performance (standing wave ratio) for antenna structures such as antenna 44 of FIGS. 6-11 has been plotted as a function of operating frequency. In the example of FIG. 12, antenna 44 has been configured to resonate in a lower frequency band LB and a higher frequency band HB. Communications bands LB and HB may be cellular telephone bands, satellite navigation system bands, local area network bands, and/or other suitable communications bands. As an example, low band LB may centered around a low band frequency F3 and may be associated with a 2.4 GHz wireless local area network band. High band HB may be centered around a high band frequency F4 and may be associated with a 5.0 GHz wireless local area network band (as an example).

Dashed curve 220 of FIG. 12 corresponds to the contribution of distributed loop antenna resonating element L1 to the performance of antenna 44. Dashed-and-dotted curve 222 corresponds to the contribution of loop antenna resonating (feed) element L2 to the performance of antenna structures 44. During operation, both elements L1 and L2 contribute to the overall performance of antenna 44, represented by curve 224. At lower frequencies such as frequencies in low band LB, antenna resonating element L2 serves as the primary radiating element in antenna 44 and antenna resonating element L1 serves as a secondary radiating element in antenna 44. At higher frequencies such as frequencies in high band HB, antenna resonating element L1 serves as the primary radiating element in antenna 44 and antenna resonating element L2 serves as a secondary radiating element. In this way, antenna 44 may transmit and receive signals in both low band LB and high band HB (e.g., 2.4 GHz and 5.0 GHz bands). When element L1 is provided with extension 70-4 (FIGS. 10 and 11), antenna 44 may be provided with greater efficiency in high band HB than in scenarios where extension 70-4 is not formed, for example. If desired, capacitor 98 may shift frequency F3 of curve 224 to a lower frequency than would otherwise be feasible given the size of antenna 44 (e.g., as described in connection with FIG. 9).

Figure 13:
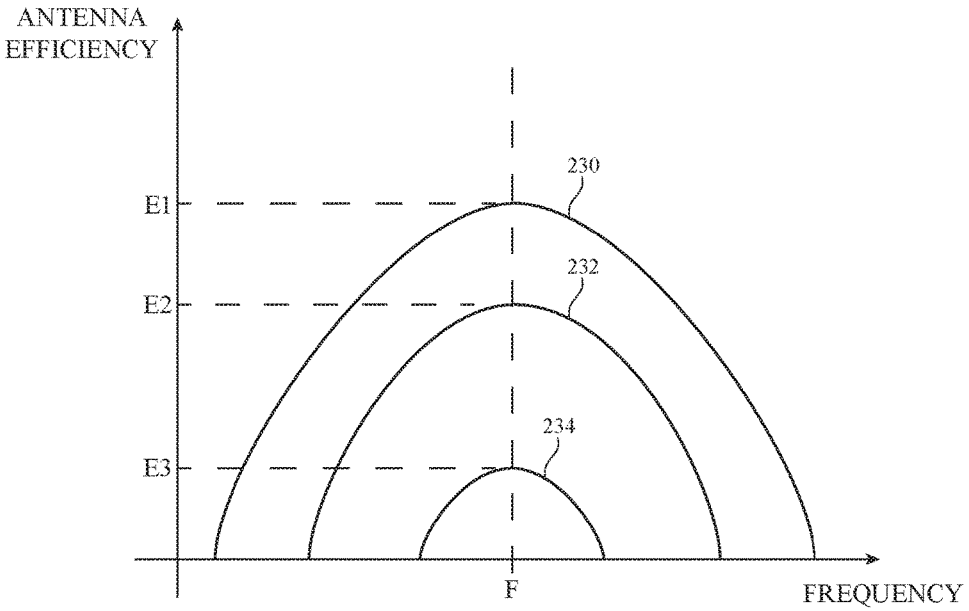
FIG. 13 is a graph of antenna performance (antenna efficiency) plotted as a function of operating frequency that shows how an illustrative antenna of the type shown in FIGS. 6-12 may exhibit optimal antenna efficiency while occupying a minimal space in accordance with an embodiment.

FIG. 13 is a graph showing how antenna efficiency varies as a function of frequency for different antenna configurations within device 10. Curve 232 illustrates the efficiency of an antenna in region 20 (FIG. 1) when implemented using a cavity-backed inverted-F antenna that is separate from housing 12. Such an arrangement may occupy a first inactive area width W (FIG. 5) such as 12 mm. The efficiency of the antenna in this configuration may peak at a level E2 at resonant frequency F (e.g., 2.4 GHz or 5.0 GHz). As the width W is reduced (e.g., to maximize the size of active display area AA), the antenna efficiency decreases. Curve 234 illustrates the efficiency of a cavity-backed inverted-F antenna that is separate from housing 12 when contained within a second width that is narrower than the first width (e.g., a width of 9 mm). The efficiency of the antenna in this configuration may peak at a level E3 at frequency F that is less than peak efficiency E2 of configuration 232. While the active area AA of display 14 is greater in this scenario, the peak antenna efficiency E3 may be less than a minimum acceptable antenna efficiency threshold associated with device 10.

Curve 230 illustrates the efficiency of antenna 44 having a configuration of the type shown in FIGS. 1-12 (e.g., in which feed element L1 and distributed loop element L2 both include portions of conductive housing 12). Such an arrangement may occupy a width W' that is less than the first width associated with curve 232. For example, width W' may be the same as the width associated with curve 232 (e.g., 9 mm) or any other desired width. However, the efficiency of antenna 44 in this configuration may peak at level E1 at frequency F that is greater than peak efficiencies E2 and E3. Similarly, antenna 44 may exhibit greater efficiency bandwidth (e.g., corresponding to a horizontal width of curve 232) than antenna configurations 232 and 234. In this way, antenna 44 may occupy a minimal amount of space within device 10 while still exhibiting an optimal (e.g., maximum) antenna efficiency E1, thereby minimizing the size of inactive area IA of display 14 and maximizing the size of active area AA of display 14 (e.g., without sacrificing antenna performance at the frequency of interest F). The example of FIG. 13 is merely illustrative. In general, antenna 44 may exhibit any desired antenna efficiency (e.g., an efficiency that exceeds a minimum acceptable antenna efficiency threshold) while occupying a minimal amount of space within device 10.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a conductive housing;

a dielectric carrier;

a loop antenna resonating element, wherein the loop antenna resonating element comprises a sheet of conductive material on the dielectric carrier;

an antenna feed structure that indirectly feeds the loop antenna resonating element and that is separated from the sheet of conductive material by a gap, wherein a portion of the antenna feed structure is formed from a portion of the conductive housing; and an electrical component that bridges the gap.

2. The electronic device defined in claim 1, wherein the antenna feed structure comprises a loop of conductive material that includes the portion of the conductive housing.

3. The electronic device defined in claim 2, wherein the loop of conductive material comprises metal traces on the dielectric carrier.

4. The electronic device defined in claim 3, wherein the metal traces on the dielectric carrier are shorted to an end of the portion of the conductive housing that forms the portion of the antenna feed structure.

5. The electronic device defined in claim 3, further comprising:

a first antenna feed terminal located on the metal traces;

a second antenna feed terminal located at an end of the portion of the conductive housing; and a radio-frequency transmission line having a signal conductor that is directly connected to the first antenna feed terminal and a ground conductor that is directly connected to the second antenna feed terminal, wherein the metal traces comprise a first segment, a second segment that extends parallel to the first segment and that is shorted to the conductive housing, and a third segment that extends between the first and second segments, the first antenna feed terminal is located at an end of the first segment, the end of the first segment is separated from the portion of the conductive housing by a first additional gap, the third segment is separated from the portion of the conductive housing by a second additional gap that is wider than the first additional gap, and the second segment is interposed between the first segment and a portion of the sheet of conductive material.

6. The electronic device defined in claim 3, wherein the electrical component comprises:

a capacitor coupled between the metal traces and the sheet of conductive material in the loop antenna resonating element.

7. The electronic device defined in claim 3, wherein the antenna feed structure comprises a parallel tank circuit that forms an open circuit between the metal traces and the conductive housing in a first frequency band and that forms a closed circuit between the metal traces and the conductive housing in a second frequency band that is lower than the first frequency band, the metal traces comprise an extended conductive segment that resonates in the second frequency band, the antenna feed structure resonates in the first frequency band, and the loop antenna resonating element resonates in the second frequency band.

8. The electronic device defined in claim 1, wherein the loop antenna resonating element comprises an additional portion of the conductive housing, the additional portion of the conductive housing and the sheet of conductive material forming a conductive loop path for the loop antenna resonating element, the conductive housing comprises a conductive housing sidewall for the electronic device that includes the portion of the conductive housing and at least some of the additional portion of the conductive housing, the electronic device further comprising:

a display having a display cover layer, wherein the conductive housing comprises a conductive rear wall for the electronic device that opposes the display cover layer, and the additional portion of the conductive housing comprises a portion of the conductive rear wall.

9. The electronic device defined in claim 1, wherein the sheet of conductive material is formed on at least first and second adjacent sides of the dielectric carrier and an additional portion of the antenna feed structure is formed from conductive structures on the first side of the dielectric carrier.

10. The electronic device defined in claim 9, wherein the loop antenna resonating element comprises a portion of electronic device rear wall and a portion of the electronic device sidewall, the conductive structures and the portion of the conductive housing form a conductive loop path of the antenna feed structure, the sheet of conductive material, the portion of electronic device rear wall, and the portion of the electronic device sidewall form an additional conductive loop path of the loop antenna resonating element, and the conductive loop path of the antenna feed structure and the additional conductive loop path of the antenna feed structure are coupled using near-field electromagnetic coupling.

11. The electronic device defined in claim 1, wherein the dielectric carrier has an air-filled cavity, the electronic device further comprising:

a speaker driver within the air-filed cavity, wherein the conductive housing comprises a first set of openings, the dielectric carrier comprises a second set of openings that are aligned with the first set of openings, and the speaker driver produces sound waves that pass through the first and second set of openings.

12. The electronic device defined in claim 1, wherein the sheet of conductive material is formed on at least one side of the dielectric carrier, the antenna feed structure comprises conductive structures formed on the one side of the dielectric carrier, and the electrical component comprises a capacitor that bridges the gap.

13. The electronic device defined in claim 1, wherein the sheet of conductive material forms at least part of a conductive loop path that loops around a first axis, the antenna feed structure includes an additional conductive loop path formed at least partly from the portion of the conductive housing, and the additional conductive loop loops around a second axis that is substantially perpendicular to the first axis.

* * * * *